US007451885B2

(12) United States Patent
Nyman et al.

(10) Patent No.: US 7,451,885 B2
(45) Date of Patent: Nov. 18, 2008

(54) LOW APPLICATION TORQUE, TAMPER EVIDENT PLASTIC CLOSURE AND CONTAINER SYSTEM WITH ENHANCED VISUAL TAMPER EVIDENCY

(75) Inventors: Henry H. Nyman, York, PA (US); David R. Cistone, Pennsville, NJ (US); Don Yeager, Millville, NJ (US); Thomas Thomas, Wallingford, PA (US)

(73) Assignee: Alcan Packaging Pharmaceutical and Personal Care, Inc., Millville, NJ (US)

( * ) Notice: Subject to any disclaimer, the term of this patent is extended or adjusted under 35 U.S.C. 154(b) by 146 days.

(21) Appl. No.: 11/047,271

(22) Filed: Jan. 31, 2005

(65) Prior Publication Data

US 2006/0169666 A1 Aug. 3, 2006

(51) Int. Cl.
*B65D 51/00* (2006.01)
*B65D 41/16* (2006.01)
*B65B 7/28* (2006.01)

(52) U.S. Cl. ..... 215/252; 215/44; 215/258; 215/321

(58) Field of Classification Search ..... 215/252, 215/258, 319–331, 43, 44
See application file for complete search history.

(56) References Cited

U.S. PATENT DOCUMENTS

| | | | |
|---|---|---|---|
| 2,054,012 | A | 9/1936 | Teller |
| 2,162,713 | A | 6/1939 | Hamberger et al. |
| 3,001,657 | A | 9/1961 | Gamble |
| 3,455,478 | A | 7/1969 | Fields et al. |
| 3,484,012 | A | 12/1969 | White et al. |
| 4,458,821 | A | 7/1984 | Ostrowsky |
| 4,501,373 | A | 2/1985 | Heinlein |
| 4,506,795 | A | 3/1985 | Herr |
| 4,511,054 | A | 4/1985 | Shank |
| 4,530,438 | A | 7/1985 | McDevitt |
| 4,541,536 | A | 9/1985 | Davis et al. |
| 4,579,241 | A | 4/1986 | Hayes |
| 4,595,110 | A | 6/1986 | Herr |
| 4,595,547 | A | 6/1986 | Herr |
| 4,715,506 | A | 12/1987 | McLaren |
| 4,753,360 | A | 6/1988 | Baxter |
| 4,828,127 | A | 5/1989 | Young et al. |
| 4,923,073 | A | 5/1990 | Wilde |

(Continued)

FOREIGN PATENT DOCUMENTS

| | | |
|---|---|---|
| EP | 1 138 609 | 4/2001 |

*Primary Examiner*—Robin Hylton
(74) *Attorney, Agent, or Firm*—RatnerPrestia

(57) ABSTRACT

A container for use with a closure is provided, and includes a receptacle, a neck extending therefrom, a closure-engaging thread segment arranged on the neck of the container to engage the closure thread segment arranged on the closure, and a plurality of spaced apart protrusions protruding radially toward the closure from the neck of the container, the plurality of spaced apart protrusions forming a protrusion pattern that has a composite orientation that is helically opposite that of the closure-engaging thread segment to engage and to separate the frangible tamper-evident band portion from the closure when the closure is rotated off of the neck. With this structure, the closure and container system provides an improved anti-backoff, tamper evident closure and container system that reduces torque used to initially apply the closure to the container and improves reliably by reducing stress on the component parts, while desirably preventing backoff from occurring.

22 Claims, 7 Drawing Sheets

U.S. PATENT DOCUMENTS 4,936,474 A 6/1990 Szczesniak et al.
5,137,163 A 8/1992 Moore
5,169,033 A 12/1992 Shay
5,271,512 A 12/1993 Ekkert
5,292,020 A 3/1994 Narin
5,402,901 A 4/1995 Carvalheiro et al.
5,484,071 A 1/1996 Zumbuhl
5,660,288 A 8/1997 Nyman, Jr.
5,664,694 A 9/1997 Bietzer et al.
5,685,445 A 11/1997 Dobbs
5,813,553 A 9/1998 Herr et al.
5,845,798 A 12/1998 Carrier
5,860,542 A * 1/1999 Takamatsu ..... 215/44
5,975,320 A 11/1999 Bietzer et al.
6,382,444 B1 5/2002 Nyman

* cited by examiner

LOW APPLICATION TORQUE, TAMPER EVIDENT PLASTIC CLOSURE AND CONTAINER SYSTEM WITH ENHANCED VISUAL TAMPER EVIDENCY

FIELD OF THE INVENTION

The present invention relates generally to a closure and container system, and more specifically, to a container which can reduce the amount of torque used to apply a tamper-evident closure to the container with more even application force to reduce stress on the frangibles that connect the tamper-evident band (i.e., drop ring) to the closure. Furthermore, tamper evidency is enhanced by the tamper-evident band being forced downward and away from the tamper-evident closure when the tamper-evident closure is removed creating a more pronounced gap between the tamper-evident closure and the tamper-evident band once the tamper-evident closure is re-applied on the container.

BACKGROUND OF THE INVENTION

Conventional containers for use with closures that include tamper-evident assemblies are well known in the art. FIG. 1 is a perspective view illustrating a conventional closure and FIG. 2 is a partial side view illustrating a conventional container for use with the conventional closure of FIG. 1.

Referring to FIGS. 1 and 2, a closure 1 includes a cap portion 10 integrally connected to a tamper-evident band portion 20, After fastening the closure 1 to a neck 50 of a container 60, plurality of tabs 30*a*, 30*b*, 30*c* . . . 30*n* connected to the bottom of the tamper evident band portion 20, engage an annular ring portion 40 of the neck 50 of the container 60. When the cap portion 10 is rotated off the neck 50 of the container 60, the tamper evident band portion 20 is separated from the cap portion 10 and is retained on the neck 50 of the container 60. That is, because the plurality of tabs 30*a*, 30*b*, 30*c* . . . 30*n* engage the annular ring portion 40 of the neck 50 of the container 60, the tamper-evident band portion 20 is prevented from moving upward, while the cap portion 10 is rotated off the neck 50 of the container 60, thus separating the cap portion 10 from the tamper evident band portion 20. Moreover, the tamper evident band portion 20 remains with the neck 50 of the container 60 and provides the user with evidence that the container 60 has already been opened.

SUMMARY OF THE INVENTION

The present invention is directed to anti-backoff, low application torque, tamper evident plastic closure and container system with enhanced visual tamper evidency. According to one exemplary embodiment, a container for use with a closure having a closure thread segment of a first helical orientation and a frangible tamper-evident band portion is provided, and the container comprises a receptacle, a neck extending from the receptacle, a closure-engaging thread segment arranged on the neck of the container to engage the closure thread segment arranged on the closure, and a plurality of spaced apart protrusions protruding radially toward the closure from the neck of the container, the plurality of spaced apart protrusions forming one or more protrusion patterns that each have a composite orientation that is helically opposite that of the closure-engaging thread segment to engage and to separate the frangible tamper-evident band portion from the closure when the closure is rotated off of the neck.

According to another exemplary embodiment, a closure and container system is provided. The closure and container system comprises a container including a receptacle, a neck extending from the receptacle, a closure-engaging thread segment of a first helical orientation, and a plurality of spaced apart protrusions radially protruding toward the closure from the neck of the container, the plurality of spaced apart protrusions forming one or more protrusion patterns that each have a composite orientation that is helically opposite that of the closure-engaging thread segment, and a closure including a cap portion, a closure thread segment provided on the cap portion to engage the closure-engaging thread segment, and a frangible tamper-evident band portion such that when the closure is rotated off of the neck of the container, the frangible tamper-evident band portion engages at least a portion of the spaced apart protrusions to separate the frangible tamper-evident band portion from the cap portion of the closure.

According to yet another exemplary embodiment, a container for use with a closure having a closure thread segment and a frangible tamper-evident band portion is provided. The container comprises a receptacle and a neck extending therefrom, a closure-engaging thread segment that at least partially helically encircles the neck for engaging the closure thread segment of the closure, and at least one band-engaging thread segment that partially helically encircles the neck in an orientation opposite the closure-engaging thread segment, for engaging the frangible tamper-evident band portion, and for separating the frangible tamper-evident band portion from the closure when the closure is rotated off of the neck.

The at least one band-engaging thread segment may be two or more band-engaging thread segments. The at least one band-engaging thread segment may be n band-engaging thread segments, where n is an integer number two or greater. The container may be made of plastic, glass or metal.

Each band-engaging thread segment may be positioned at an elevation that is between those of the closure-engaging thread segment and the receptacle.

Two or more band-engaging thread segments may be spaced apart and each may at least partially encircle the neck in a helical pattern. A plurality of helical lines may helically encircle the neck of the container and may define a respective helical pattern such that a corresponding one or ones of the spaced apart band-engaging thread segments may be positioned along a respective one of the helical lines.

Beginning positions of the spaced apart band-engaging thread segments may be at a substantially common elevation relative to an opening of the container. Ending positions of the spaced apart band-engaging thread segments may be at a substantially common elevation relative to the opening of the container.

Beginning positions of respective ones of the spaced apart band-engaging thread segments may be at different elevations relative to the opening of the container.

Ending positions of respective ones of the spaced apart band-engaging thread segments may be at different elevations relative to the opening of the container.

The frangible tamper-evident band portion may comprises a band and a plurality of flexible tabs coupled thereto and the at least one band engaging thread segment may be profiled such that at least a portion of the plurality of flexible tabs of the frangible tamper-evident band portion may folded back while the closure is rotated on the neck.

According to yet another exemplary embodiment, the closure and container system comprises a container including a receptacle, a neck extending from the receptacle, a closure-engaging thread segment that at least partially helically encircles the neck, and at least one band-engaging thread segment, helically opposite that of the closure-engaging thread segment, and a closure including a cap portion, a closure thread segment provided on the cap portion to engage the closure-engaging thread segment, and a frangible tamper-evident band portion coupled to the cap portion, and having a band and at least one tab directed inwardly and upwardly with respect to the band and coupled therewith, for engaging the at least one band-engaging thread segment of the neck of the container, wherein the at least one band-engaging thread segment separates the frangible tamper-evident band portion from the cap portion when the closure is rotated off of the neck.

Additional aspects and/or advantages of the present invention will be set forth in part in the description which follows and, in part, will be obvious from the description, or may be learned by practice of the invention.

BRIEF DESCRIPTION OF THE DRAWINGS

The invention is best understood from the following detailed description when read in connection with the accompanying drawing. It is emphasized that, according to common practice, the various features of the drawing may not be drawn to scale. On the contrary, the dimensions of the various features may be arbitrarily expanded or reduced for clarity. Moreover, in the drawings, common numerical references are used to represent like features. Included in the drawing are the following figures.

DETAILED DESCRIPTION

Definition of Terms

A "thread" generally refers to forming ridges and/or valleys which spiral about either an inner surface (e.g., of a closure) or an outer surface (e.g., of a neck of a container) in a continuous manner and fully encircles, for example, the closure and/or neck at least one time.

A "thread segment" refers to a portion of a thread and may only partially encircle, for example, a neck or a closure.

A "helical pattern" refers to a pattern having a composite orientation corresponding to a helical line (e.g., to form a piece-wise helical projection).

DESCRIPTION OF THE INVENTION

Tamper-evident closures are prone to "backoff," which refers to a condition in which a tamper-evident closure is partially removed from a container to the point of breaking the seal between the tamper-evident closure and the container without demonstrating damage to frangible elements of the tamper-evident closure. In this condition, it may be possible to dispense product, and in particular, to dispense liquids, through the broken seal. Variations in actual dimensions of a closure and a container from their design dimensions may create unintended gaps between features and allow for this "backoff" effect.

Figure 1:
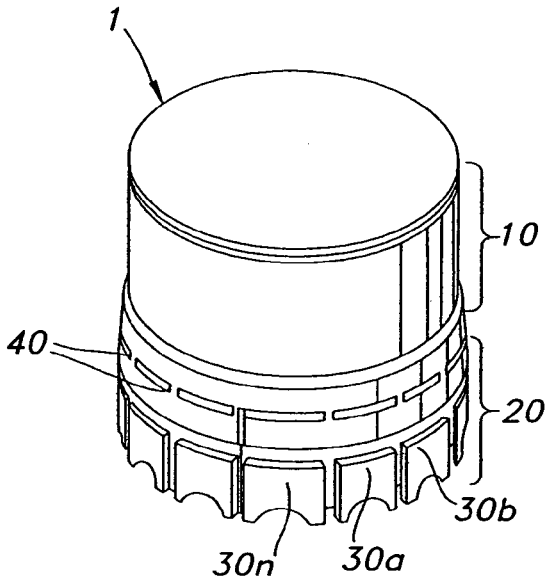
FIG. 1 (PRIOR ART)
FIG. 1 is a perspective view illustrating a conventional closure.
Figure 2:
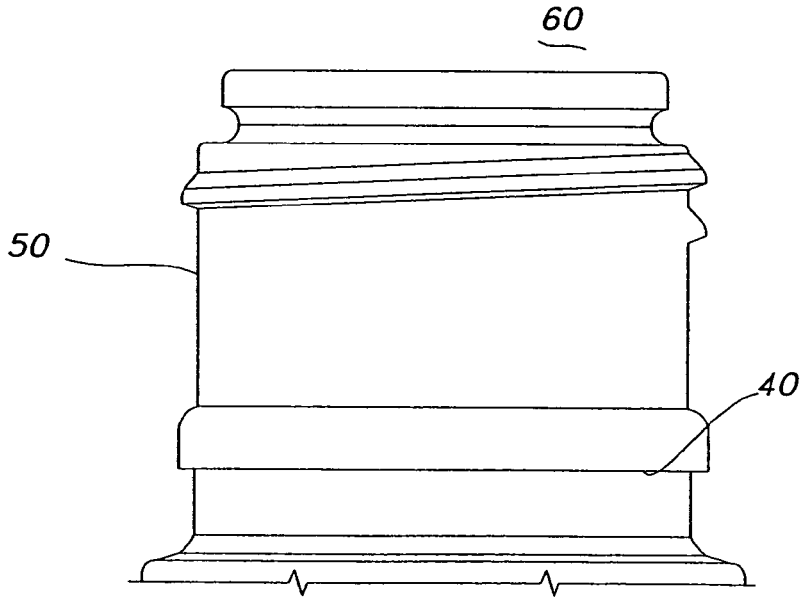
FIG. 2 (PRIOR ART)
FIG. 2 is a partial side/cut away view illustrating a conventional container.
Figure 3:
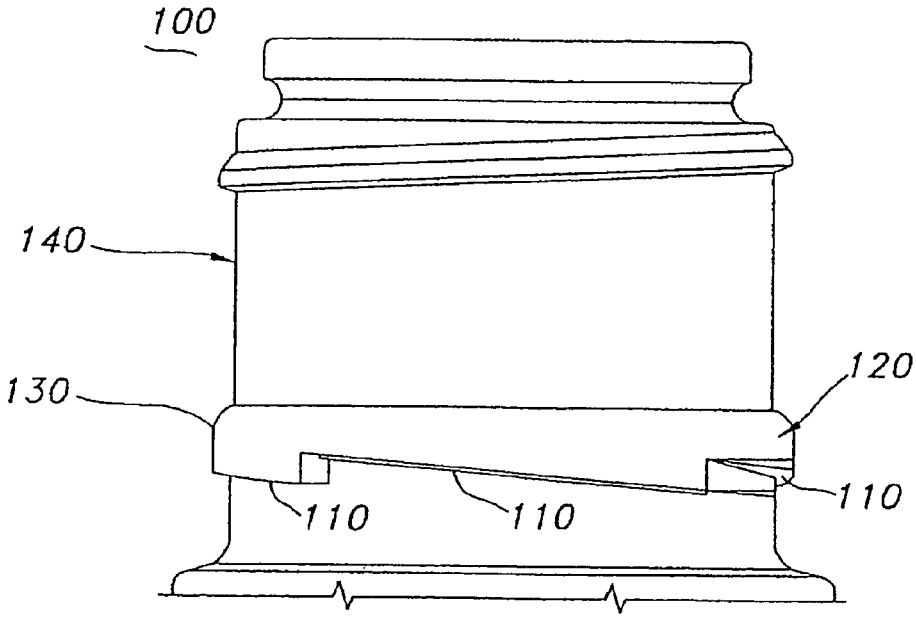
FIG. 3 (PRIOR ART)
FIG. 3 is a partial side/cut away view illustrating another conventional container used with the conventional closure of FIG. 1.

FIG. 3 is a partial side/cut away view illustrating another conventional container neck used with the conventional closure of FIG. 1.

Referring to FIGS. 1 and 3, a closure system may include a conventional container 100 of FIG. 3 for use with the closure 1 of FIG. 1 and may reduce or may eliminate the effect of backoff. The plurality of tabs 30*a*, 30*b*, 30*c* . . . 30*n* connected to the bottom of the tamper-evident band portion 20 engage a series of helical ramps 110 profiled into an underside of an annular tamper-evident retention bead 120. Since the underside of the annular tamper-evident retention bead 120 is configured as the series of helical ramps 110, the effect of variations in actual dimensions from their design dimensions can be reduced or eliminated. Moreover, because a portion of the plurality of tabs 30*a*, 30*b*, 30*c* . . . 30*n* can be made to have a limited clearance (i.e., have substantially no gap) with at least a portion of the helical ramps 110, separation of the tamper-evident tab portion 20 from the cap portion 10 is accelerated. However, this closure system of the container 100 for use with the closure 1 may have of the following problems: (1) high application forces to initially close the closure 1 over the annular tamper-evident retention bead 120 of the container 100 is required because the plurality of tabs 30*a*, 30*b*, 30*c* . . . 30*n* are simultaneously folded and stretched over an annular portion 130 of the tamper-evident retention bead 120; (2) the frangible elements 40 of the closure 1 that connect the cap portion 10 with the tamper-evident band portion 20 may be stressed due to the high application forces and the degree of folding and stretching of the plurality of tabs 30*a*, 30*b*, 30*c* . . . 30*n* over the annular portion 130 of the tamper-evident retention bead 120 to properly apply the closure 1 to the container 100; and (3) the tamper-evident retention bead 120 construction is bulky, thereby adding to part weight of the container 100. Moreover, due to this bulkiness, features of the container 100 and the closure 1 used to separate the tamper-evident band portion 20 from the cap portion 10 may be distorted by heating processes used to make the container 100 and the closure 1.

What is needed is an improved closure and container system which solves the above-mentioned problems. More particularly, a closure and container system is needed which reduces a closure application force used to initially apply the closure including a tamper-evident band portion on the neck of the container.

Figure 4A:
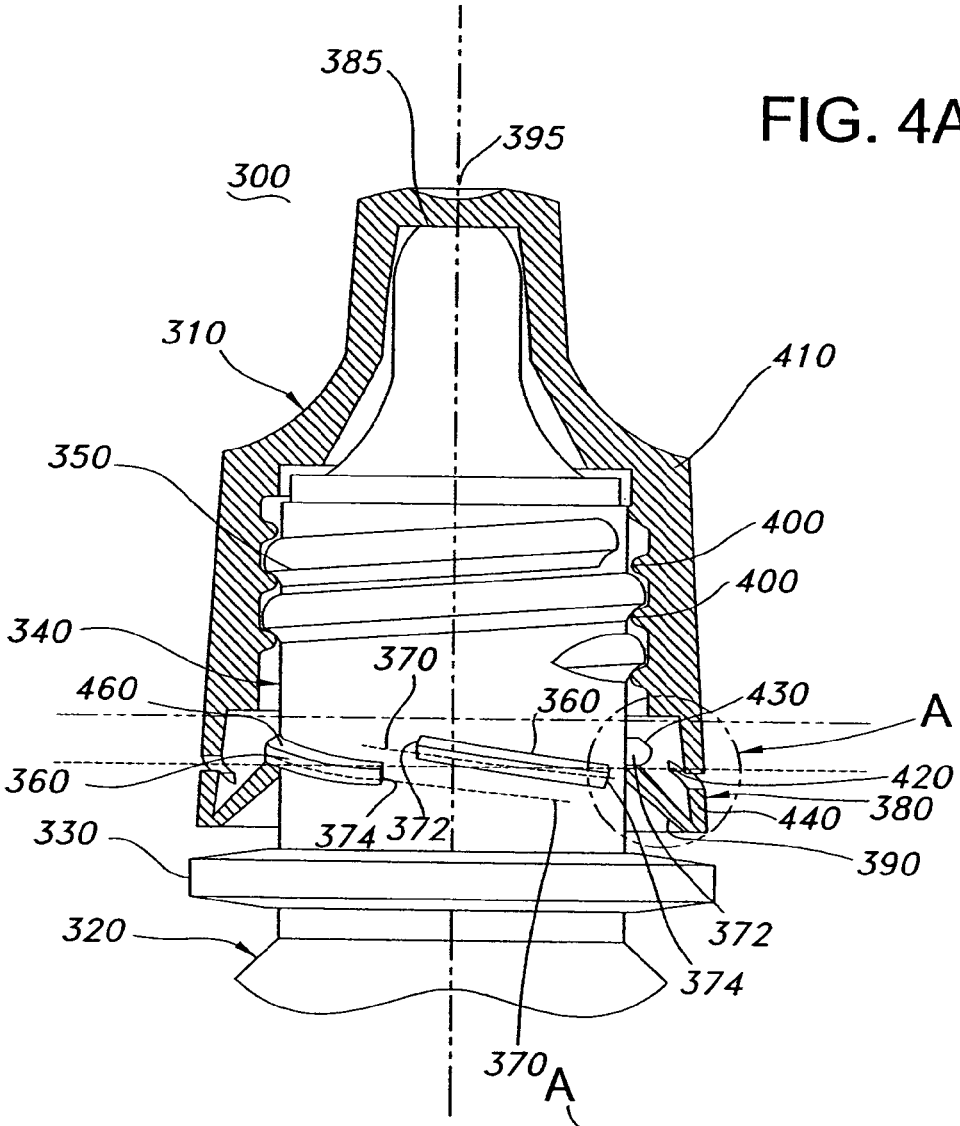
FIG. 4A is partial side/cut away view illustrating a closure and container system of an exemplary embodiment of the present invention.
Figure 4B:
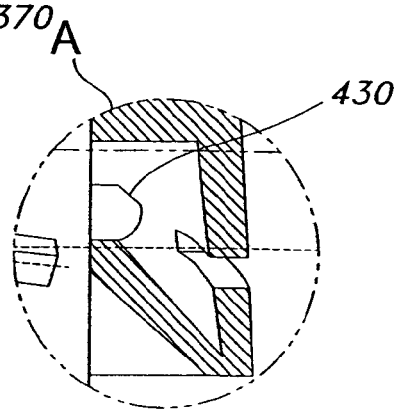
FIG. 4B is a enlarged view of area A of FIG. 4A.

FIG. 4A is a partial side/cut away view illustrating a closure and container system 300 of an exemplary embodiment of the present invention. FIG. 4B is an enlarged view of area A of FIG. 4A.

Referring to FIGS. 4A-4B, the closure and container system 300 includes a tamper-evident closure 310 and a container 320. The container 320 may include a shoulder 330, and a neck 340 extend therefrom. The container 320 preferably may be made of plastic or, otherwise, may be made of glass or metal. The container 320 may be formed by any number of forming operations such as a molding operation, a blowing operation or a casting operation, among others, so long as tolerances of features of the neck 340 are sufficient to ensure proper closing of the tamper-evident closure 310 to the container 320 and prevent "backoff" from occurring. The neck 340 of the container 320 may have one or more closure-engaging thread segments 350 formed either internally or externally thereon in a first helical orientation (i.e. a left handed helical orientation or a right handed helical orientation). That is, one closure-engaging thread segment 350 may helically encircle either a portion or a whole of the neck 340, one closure-engaging thread segment 350 may helically encircle the neck 340 a plurality of times, a plurality of closure-engaging thread segments 350 may each helically encircle either a portion or a whole of the neck 340, in succession, or a plurality of closure-engaging thread segments 350 may each encircle the neck 340 a plurality of times, in succession.

The neck 340 of the container 320 may have one or more band-engaging thread segments 360 formed externally thereon in a second helical orientation (i.e., opposite the first helical orientation). In this configuration, one band-engaging thread segment 360 may helically encircle a portion of the neck 340, or plural band-engaging thread segments 360 may each helically encircle a portion of the neck 340 in one or more helical patterns. The plural band-engaging thread segments 360 may be formed spaced apart in the one or more helical patterns. Moreover, the plural band-engaging thread segments 360 may be preferably formed in substantially uniform helical patterns (i.e., each of the helical patterns being substantially common in a shape thereof and having gaps between neighboring helical patterns which are substantially common in size). Each helical pattern is defined by a helical line 370 that helically encircles the neck 340 of the container 320 such that the spaced apart band-engaging thread segments 360 are positioned extending along a respective helical line 370.

Each helical line 370 may encircle the neck at a constant helix angle in a range of about 1 to 10 degrees or have a variable helix angle which becomes steeper as the elevation of the helical line moves away from the elevation of an opening 385 of the container 320.

It is preferred that beginning positions 372 of all of the spaced apart band-engaging thread segments 360 be at a substantially common elevation relative to that of the opening 385 of the container 370. Further, it is preferred that ending positions 374 of all of the spaced apart band-engaging thread segments 360 be at another substantially common elevation relative to that of the opening 385 of the container 320.

However, it is contemplated that at least the beginning positions 372 of respective ones of the spaced apart band-engaging thread segments 360 may be at different elevations relative to that of the opening 385 of the container 320. It is further contemplated that the ending positions 374 of respective ones of the spaced apart band-engaging thread segments 370 may be at different elevations relative to that of the opening 385 of the container 320.

The one or more closure-engaging thread segments 350 formed externally on the neck 340 of the container 320 in the first helical orientation (i.e. a left handed helical orientation or a right handed helical orientation) may engage corresponding closure thread segments 400 on the tamper-evident closure 310. That is, the one or more closure-engaging thread segments 350 and the corresponding one or more closure thread segments 400 of the tamper-evident closure 310 may engage to close the opening 385 of the container 320 by threading the tamper-evident closure 310 onto the neck 340 of the container 320 in a first direction (i.e. either clockwise or counterclockwise) according to the first helical orientation. The helical structure of the one or more closure-engaging and closure thread segments 350 and 400 allows the tamper-evident closure 310 to move in a direction parallel to an axis 395 of the container 320 and away from the opening 385 of the container 320, when the tamper-evident closure 310 is rotated off of the neck 340.

It is contemplated that an alternative embodiment (not shown) could have one or more closure-engaging thread segments may be provided on the interior of the neck 340 of the container 320 and that the tamper-evident closure 310 and the neck 340 may be structured such that the tamper-evident closure 310 includes an interior portion to be threaded into the neck 340 of the container 320 having one or more closure-thread segments 400.

The tamper-evident closure 310 preferably includes a cap portion 410 and a frangible tamper-evident band portion 380 having a band 440 with a plurality of flexible tabs 390 connected therewith. Moreover, band 440 of the flangible tamper-evident band portion 380 may encircle the neck 340 of the container 320 at a tamper-evident position, after the tamper-evident closure 310 is fully, initially applied. The cap portion 410 and the band 440 of the frangible tamper-evident band portion 380 may be coupled by a plurality of frangible elements 420 such that at least a portion of the plural flexible tabs 390 may engage with the one or more band-engaging thread segments 360. That is, the plurality of flexible tabs 390 are configured to engage the one or more band-engaging thread segments 360 to separate the frangible tamper-evident band portion 380 from the cap portion 410 when the tamper-evident closure 310 is initially rotated off the neck 340. Because the plurality of tabs 390 are flexible, the closure application force to initially close the tamper-evident closure 310 (i.e., to position the tamper-evident closure 310 in the tamper-evident position) may be reduced by providing clearance for the plurality of flexible tabs 390 to rotate away from the one or more band engaging thread segments 360, and more particularly, the closure application force to close the tamper-evident closure 310 to the container 320 may be reduced in comparison to non-flexible structures such as lug structures or non-flexible tabs.

By reducing the application force below a predetermined threshold amount (i.e., providing a low torque closure system), the tamper-evident closure may be applied by conventional capping machines including the preferred chuck capping machines. One of ordinary skill in the art will recognize that the conventional tamper-evident closures are normally applied by chuck capping machines because, otherwise, the application force to apply the conventional tamper-evident closures produces defects in conventional tamper-evident closures that may visually appear to be tampering to a user.

Furthermore, because the one or more band-engaging thread segments 360 are not annular and may be a series of left or right handed band-engaging thread segments 360, the series of left or right handed band-engaging thread segments 360 may be profiled with a chamfer 430 to ease the plurality of flexible tabs 390 over the one or more band-engaging thread segments 360 during initial application of the tamper-evident closure 310.

Moreover, due to the helical pattern (e.g., the one or series of left or right handed band-engaging thread segments 360), only portions of band 440 of the frangible tamper-evident band portion 380 have to be stretched over the one or more band-engaging thread segments 360 at one time. That is, the entire frangible tamper-evident band portion 380 is not simultaneously stretched over the one or more band-engaging thread segments 360 at one time during closure rotation thereby reducing the closure application torque (i.e., force) is necessary to close the container 320. For example, because there is no substantially annular retention bead, (such as is shown in FIG. 3) respective flexible tabs 390 may be individually or in groups ratcheted over respective band-engaging thread segments 360, and a remainder of the plurality of flexible tabs 390 need not be ratcheted over the band-engaging thread segments 360 because the helical pattern is configured such that only a portion of the plurality of flexible tabs 390 engage with less than all of the band-engaging thread segments 360 at any one time during closure rotation. Accordingly, this minimizes the closure application torque. With the application force reduced, there is a reduced tendency for compressive forces, and rotational forces, to be applied to the frangible elements 420 connecting the cap portion 410 of the tamper-evident closure 310 with the frangible tamper-evident band portion 380. This reduces the likelihood of severance of the frangible elements 420 during initial application of the tamper-evident closure 310. Reduced initial application force adds consistency to final application force.

Because a plurality of flexible tabs 390 are preferably used, a portion of the flexible tabs 390 may be trapped under the one or more band-engaging thread segments 360 after the frangible tamper-evident band portion 380 is positioned at the tamper-evident position. Thus, if the tamper-evident closure 310 is rotated off the neck 340 of the container 320, the frangible tamper-evident band portion 380 may be retained between the shoulder 330 of the container 320 and the one or more band-engaging thread segments 360.

Moreover, during removal rotation of the tamper-evident closure 310 off the neck 340 of the container 320, other ones of the plurality of flexible tabs 390 may become trapped under and may engage with the one or more band-engaging thread segments 360 to allow for separation of the frangible tamper-evident band portion 380 from the cap portion 410 and to minimize an amount of potential "back-off" that may result.

The one or more band-engaging thread segments 360 may have on a leading edge thereof, a chamfer 430 (best shown in FIG. 4B) which promotes flexing of the plurality of flexible tabs 390 of the frangible tamper evident band portion 380 upward during cap application, thus lowering the application force required. With the application force reduced, there is a reduced tendency for compressive forces, and rotational forces, to be applied to the frangible elements 420 connecting the cap portion 410 of the tamper-evident closure 310 with the frangible tamper-evident band portion 380. This reduces distortion and prevents severance of the frangible elements 420. Moreover, a smaller cross-section of the one or more band engaging-thread segments 360, due in part to the chamfer 430, may reduce the weight of the container 320, and may result in a reduced amount of heat concentrated in the neck 340 of the container 320.

The one or more band-engaging thread segments 360 may have cross-sectional profiles of triangular shapes or any other cross-sectional profile that may engage the plurality of flexible tabs 390 of the flangible tamper-evident band portion 380. Each of the flexible tabs 390 may have a profile which corresponds to a profile of the underside of the one or more band-engaging thread segments 360 to increase separation force when the closure 310 is rotated off the neck 340 of the container 320.

After the tamper-evident closure 310 is rotated off the neck 340 of the container 320 and then reapplied to close the container 320, a visual gap is produced between the frangible tamper-evident band portion 380 and cap portion 410 which allows a user to view that the cap portion 410 has been removed (i.e., tampered with) even after the cap portion 410 has been full reapplied to the neck 340 of the container 320.

Although the exemplary embodiment illustrates a container having a nipple opening, it is contemplated that the other type of containers are possible, for example, a container without a nipple opening, or a container with a pour spout opening, among others.

Although the exemplary embodiment illustrates a container for use with a closure without a child resistant opening feature, it is contemplated that the container can be implemented with any number of known child resistant opening features.

FIGS. 5-8 are partial side/cut away views, respectively, illustrating containers having one or more band-engaging protrusions in helical patterns according to other exemplary embodiments of the present invention. A composite orientation of each of the helical patterns being in an orientation opposite that of the closure-engaging thread segment of the container. For brevity, features of these embodiments already discussed in other embodiments will not be discussed below.

Figure 5:
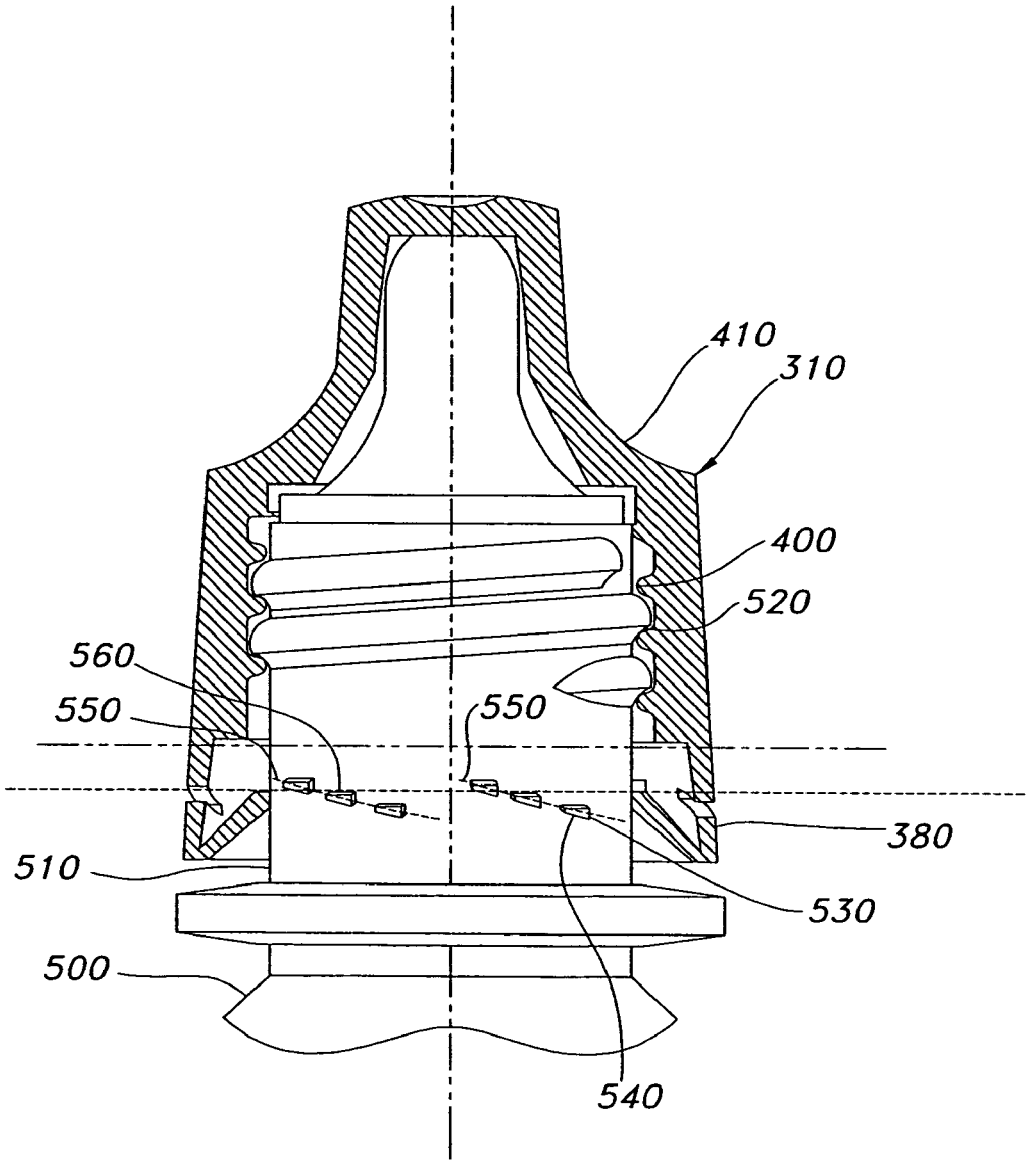
FIG. 5 is a partial side/cut away view illustrating a container of another exemplary embodiment of the present invention.

Referring to FIG. 5, a container 500 for use with the tamper-evident closure 310 is provided. The container 500 may include a receptacle (not shown), a neck 510, extending from the receptacle, a closure-engaging thread segment 520 arranged on the neck 510 of the container 500 to engage the closure thread segment 400 arranged on the tamper-evident closure 310, and a plurality of spaced apart protrusions 530 protruding radially toward the tamper-evident closure 310 from the neck 510 of the container 500. The plurality of spaced apart protrusions 530 may form one or more sets of protrusions 530. Each set of protrusions 530 may form a protrusion pattern such that each protrusion pattern may have a composite orientation that is helically opposite that of the closure-engaging thread segment 520 to engage and to separate the frangible tamper-evident band portion 380 of the tamper-evident closure 310 from the cap portion 410 when the tamper-evident closure 310 is rotated off of the neck 510 of the container 500.

Each of the helical patterns formed by the spaced apart protrusions 530 is formed as plural trapezoidal shaped projections which extend along a respective one of plural helical lines 550 which helically encircle the neck 510 of the container 500.

After the tamper-evident closure 310 is rotated off the neck 510 of the container 500 and then reapplied to close the container 500, a visual gap is produced between the frangible tamper-evident band portion 380 and cap portion 410 which allows a user to view that the cap portion 410 has been removed (i.e., tampered with) even after the cap portion 410 has been full reapplied to the neck 510 of the container 500.

Figure 6:
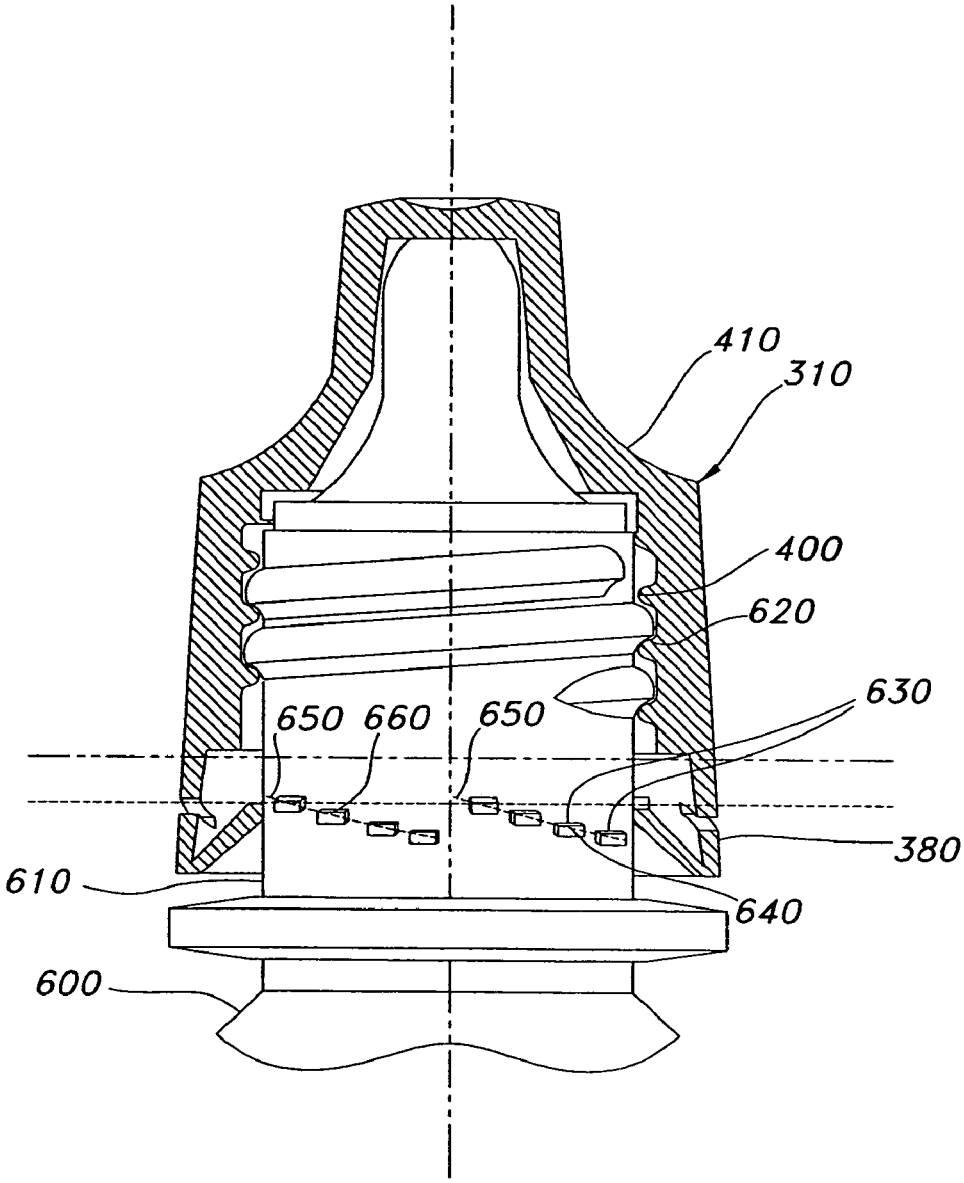
FIG. 6 is partial side/cut away view illustrating a container of yet another exemplary embodiment of the present invention.

Referring to FIG. 6, a container 600 for use with the tamper-evident closure 310 is provided. The container 600 may include a receptacle (not shown), a neck 610, extending from the receptacle, a closure-engaging thread segment 620 arranged on the neck 610 of the container 600 to engage the closure thread segment 400 arranged on the tamper-evident closure 310, and a plurality of spaced apart protrusions 630 protruding radially toward the tamper-evident closure 310 from the neck 610 of the container 600. The plurality of spaced apart protrusions 630 may form one or more sets of protrusions 630. Each set of protrusions 630 may form a protrusion pattern such that each protrusion pattern may have a composite orientation that is helically opposite that of the closure-engaging thread segment 620 to engage and to separate the frangible tamper-evident band portion 380 of the tamper-evident closure 310 from the cap portion 410 when the tamper-evident closure 310 is rotated off of the neck 610 of the container 600.

Each of the helical patterns formed by the spaced apart protrusions 630 is formed as spaced apart rectangular shaped projections which extend along a respective one of plural helical lines 650 that helically encircle the neck 610 of the container 600.

After the tamper-evident closure 310 is rotated off the neck 610 of the container 600 and then reapplied to close the container 600, a visual gap is produced between the frangible tamper-evident band portion 380 and cap portion 410 which allows a user to view that the cap portion 410 has been removed (i.e., tampered with) even after the cap portion 410 has been full reapplied to the neck 610 of the container 600.

Figure 7:
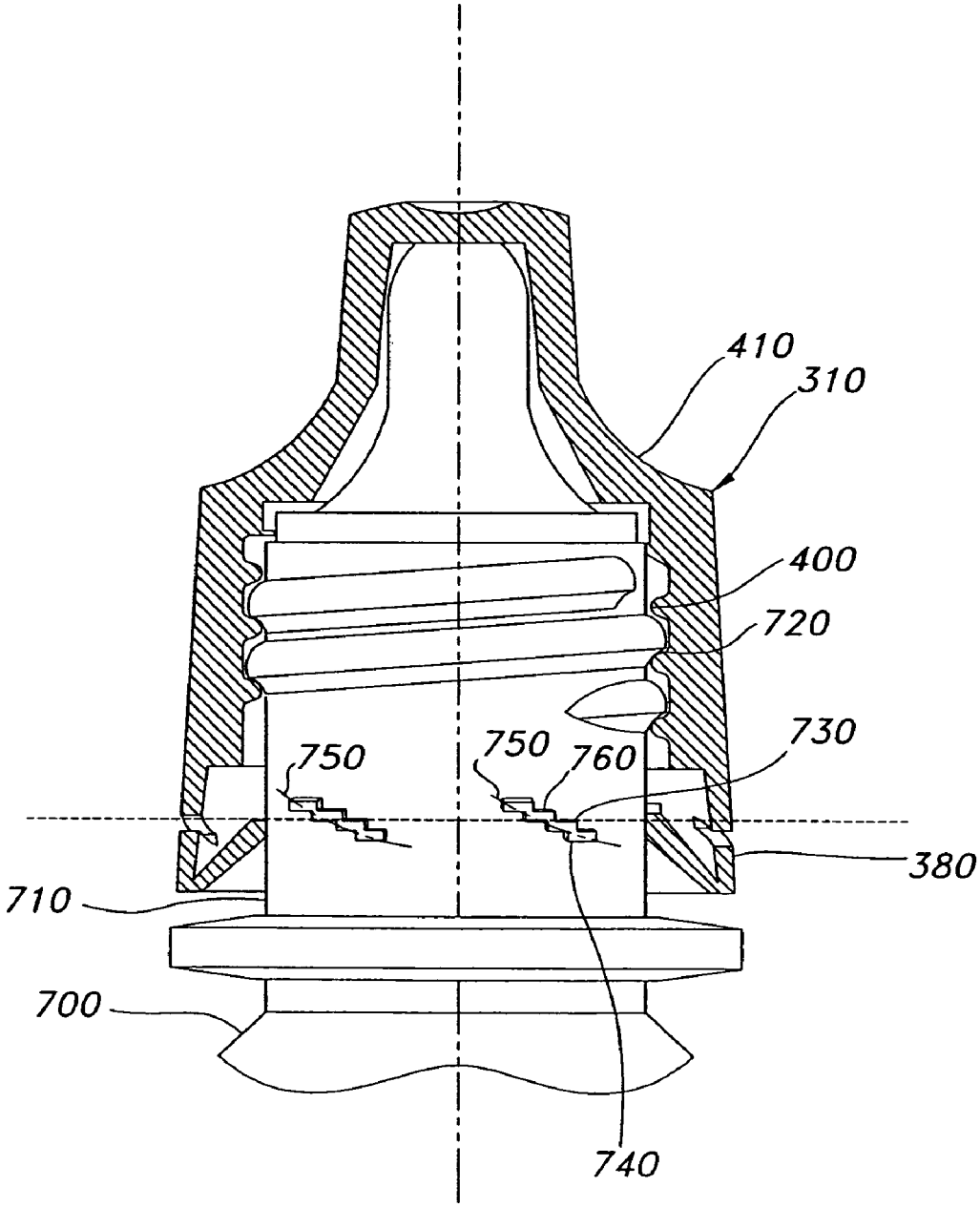
FIG. 7 is partial side/cut away view illustrating a container of yet another exemplary embodiment of the present invention.

Referring to FIG. 7, a container 700 for use with the tamper-evident closure 310 is provided. The container 700 may include a receptacle (not shown), a neck 710, extending from the receptacle, a closure-engaging thread segment 720 arranged on the neck 710 of the container 700 to engage the closure thread segment 400 arranged on the tamper-evident closure 310, and a plurality of spaced apart protrusions 730 protruding radially toward the tamper-evident closure 310 from the neck 710 of the container 700. The plurality of spaced apart protrusions 730 may form one or more sets of protrusions 730. Each set of protrusions 730 may form a protrusion pattern such that each protrusion pattern may have a composite orientation that is helically opposite that of the closure-engaging thread segment 720 to engage and to separate the frangible tamper-evident band portion 380 of the tamper-evident closure 310 from the cap portion 410 when the tamper-evident closure 310 is rotated off of the neck 710 of the container 700.

Each of the helical patterns formed by the spaced apart protrusions 730 is formed as a stair-step shaped projection which extends along a respective one of plural helical lines 750 that helically encircle the neck 710 of the container 700.

After the tamper-evident closure 310 is rotated off the neck 710 of the container 700 and then reapplied to close the container 700, a visual gap is produced between the frangible tamper-evident band portion 380 and cap portion 410 which allows a user to view that the cap portion 410 has been removed (i.e., tampered with) even after the cap portion 410 has been full reapplied to the neck 710 of the container 700.

Figure 8:
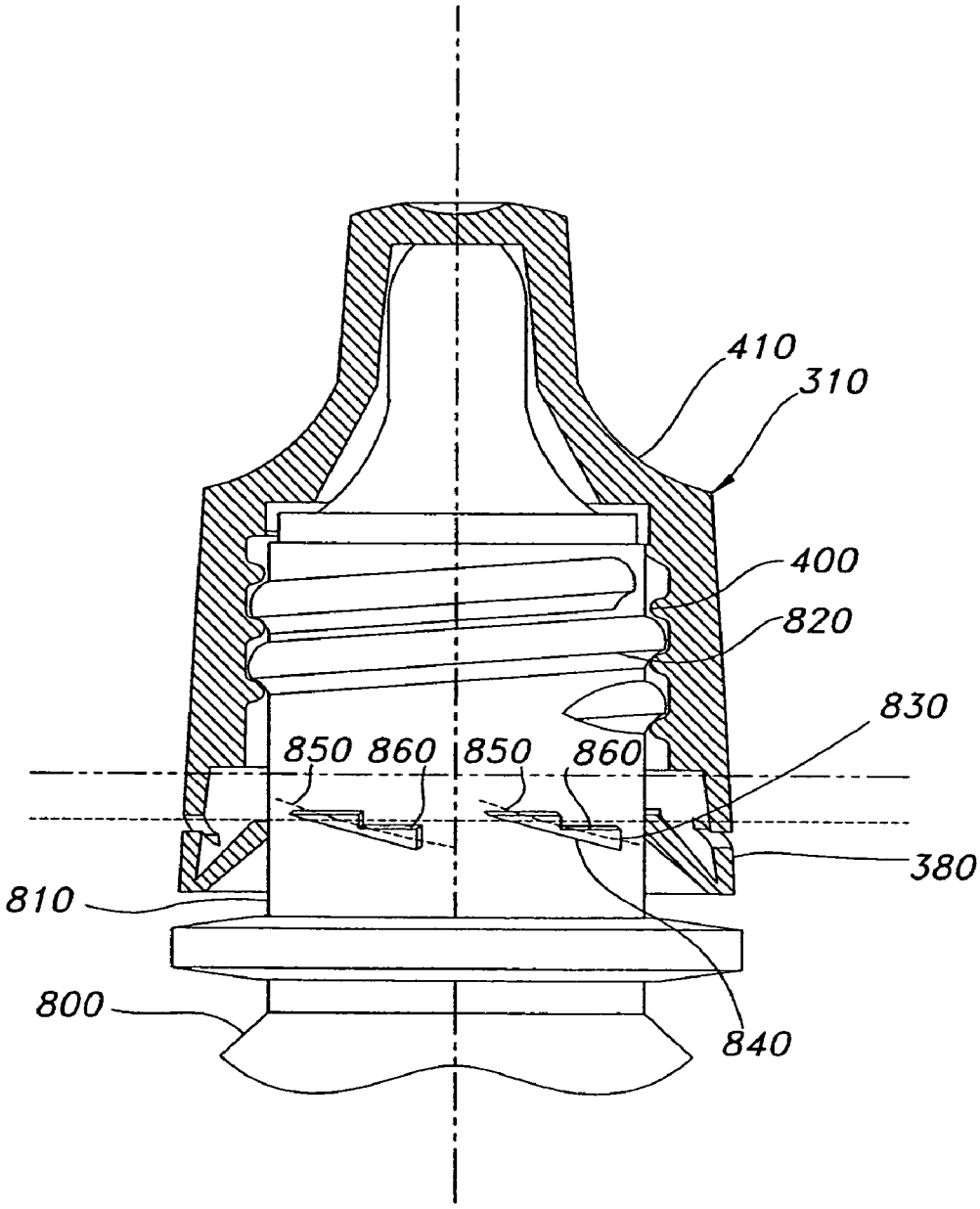
FIG. 8 is partial side/cut away view illustrating a container of yet another exemplary embodiment of the present invention.

Referring to FIG. 8, a container 800 for use with the tamper-evident closure 310 is provided. The container 800 may include a receptacle (not shown), a neck 810, extending from the receptacle, a closure-engaging thread segment 820 arranged on the neck 810 of the container 800 to engage the closure thread segment 400 arranged on the tamper-evident closure 310, and a plurality of spaced apart protrusions 830 protruding radially toward the tamper-evident closure 310 from the neck 810 of the container 800. The plurality of spaced apart protrusions 830 may form one or more sets of protrusions 830. Each set of protrusions 830 may form a protrusion pattern such that each protrusion pattern may have a composite orientation that is helically opposite that of the closure-engaging thread segment 820 to engage and to separate the frangible tamper-evident band portion 380 of the tamper-evident closure 310 from the cap portion 410 when the tamper-evident closure 310 is rotated off of the neck 810 of the container 800.

Each of the helical patterns formed by the spaced apart protrusions 830 is formed as a stair-stepped ramp projection which extend along a respective one of plural helical lines 850 which helically encircle the neck 810 of the container 800.

After the tamper-evident closure 310 is rotated off the neck 810 of the container 800 and then reapplied to close the container 800, a visual gap is produced between the frangible tamper-evident band portion 380 and cap portion 410 which allows a user to view that the cap portion 410 has been removed (i.e., tampered with) even after the cap portion 410 has been full reapplied to the neck 810 of the container 800.

As illustrated in FIGS. 5 and 8, it is preferred that each of the spaced apart protrusions have a bottom portion 540 and 840 which extends along and corresponds to the composite orientation of the helical pattern to reduce or to eliminate the effect of backoff.

Each of the exemplary embodiments illustrated in FIGS. 5-8 include respective spaced apart protrusions 530, 630, 730 and 830 for which the closure force to initially rotate the closure 310 to the tamper-evident position is reduced compared to that of having a substantially annular bead around a neck of a container. This is accomplished with a combination of gaps between respective spaced apart protrusions 530, 630, 730 and 830 and differing elevations with respect to the opening of the upper surfaces 560, 660, 760 and 860 of the respective spaced apart protrusions 530, 630, 730 and 830, thus reducing the force required to initially apply the closure 310 to the corresponding container 500, 600, 700 and 800 when the flangible tamper-evident band portion 380 is moved to the tamper-evident position.

Although several embodiments of the spaced apart projections have been illustrated, it is contemplated that one of ordinary skill will recognize that other shapes for the spaced apart protrusions may be implemented, so long as the spaced apart protrusions form reverse helical patterns with respect to the orientation of the closure-engaging threads.

It is preferable that only a portion of the plurality of flexible tabs 390 of the tamper-evident closure 310 be in contact with respective spaced apart protrusions 530, 630, 730 and 830 at any one time. That is, a portion of the plurality of flexible tabs 390 may disengage contact with the respective spaced apart protrusions 530, 630, 730 and 830 before other portions of the plurality of flexible tabs 390 engage contact with the respective spaced apart protrusions 530, 630, 730 and 830, when the tamper-evident closure 310 is rotated on the neck 510, 610, 710 and 810 of the respective container 500, 600, 700 and 800 and/or a portion of the plurality of flexible tabs 390 may never contact with the respective spaced apart protrusions 530, 630, 730 and 830.

Because of the reduced torque needed to cap the closure and container systems as shown the various exemplary embodiments of the present invention, any general purpose capper machine may be used therewith. This is in contrast to a conventional closure and container system having a frangible tamper-evident band which can only be capped using a chuck capper machine.

It is also important to note that this type of tamper-evident system, while useful in any tamper-evident system may also be advantageously used in combination with child-resistant closures known in the art.

Those skilled in the art will understand that the various optional features of the disclosed container may be combined in any number of ways without departing from the scope of the present invention. In addition, while the invention has been described in regard to a container which may accommodate closures with tabs, those skilled in the art will recognize that a closure according to the present invention may be any shape and that the scope of the invention is to be limited only by the claims appended hereto and equivalents thereof.

What is claimed is:

1. A container for use with a closure having a closure thread segment of a first helical orientation and a frangible tamper-evident band portion, the container comprising:

a receptacle;

a neck extending from the receptacle;

a closure-engaging thread segment arranged on the neck of the container to engage the closure thread segment of the closure; and a plurality of circumferentially spaced apart protrusions protruding radially outward from the neck of the container, the plurality of spaced apart protrusions forming two or more protrusion patterns, each pattern having a same elevation relative to an opening of the container and a composite orientation that is helically opposite that of the closure-engaging thread segment to engage and to separate the frangible tamper-evident band portion from the closure when the closure is rotated off of the neck.

2. A closure and container system, comprising:

a container including:

a receptacle, a neck extending from the receptacle, a closure-engaging thread segment of a first helical orientation, and a plurality of circumferentially spaced apart protrusions protruding radially outward from the neck of the container, the plurality of spaced apart protrusions forming two or more repeating helical protrusion patterns that each have a common elevation relative to an opening of the container and a composite orientation that is helically opposite that of the closure-engaging thread segment; and a closure including:

a cap portion, a closure thread segment provided on said cap portion to engage the closure- engaging thread segment, and a frangible tamper-evident band portion such that when the closure is rotated off of the neck of the container, the frangible tamper-evident band portion engages at least a portion of the spaced apart protrusions to separate the frangible tamper-evident band portion from the cap portion of the closure.

3. A container for use with a closure having a closure thread segment and a frangible tamper-evident band portion, said container comprising:

a receptacle;

a neck extending from the receptacle;

a closure-engaging thread segment that at least partially helically encircles the neck for engaging the closure thread segment of the closure; and two or more circumferentially spaced apart band-engaging thread segments that partially helically -encircle the neck at a same elevation relative to an opening of the container in an orientation opposite the closure-engaging thread segment, for engaging the frangible tamper-evident band portion, and for separating the frangible tamper-evident band portion from the closure when the closure is rotated off of the neck.

4. The container of claim 3, wherein a visual gap is formed between the separated frangible tamper-evident band portion and the closure when the closure is fully rotated back on to the neck of the container.

5. The container of claim 3, wherein the closure-engaging thread segment is oriented right handed.

6. The container of claim 3, wherein the orientation of the two or more band-engaging thread segment is left-handed.

7. The container of claim 3, wherein the closure thread segment helically encircles the neck at least once.

8. The container of claim 3, wherein each band-engaging thread segment is positioned at an elevation that is between those of the closure-engaging thread segment and the receptacle.

9. The container of claim 3, wherein the container is made of plastic, glass or metal.

10. The container of claim 3, wherein each band engaging thread segment partially encircle the neck in one or more helical patterns.

11. The container of claim 10, wherein each of the helical patterns is a substantially common helical pattern.

12. A container for use with a closure having a closure thread segment and a frangible tamper-evident band portion, said container comprising:

a receptacle;

a neck extending from the receptacle;

a closure-engaging thread segment that at least partially helically encircles the neck for engaging the closure thread segment of the closure; and two or more band-engaging thread segments that partially helically encircle the neck at a common elevation relative to an opening of the container in an orientation opposite the closure-engaging thread segment, for engaging the frangible tamper-evident band portion, and for separating the frangible tamper-evident band portion from the closure when the closure is rotated off of the neck, wherein the two or more band engaging thread segments are circumferentially spaced apart and each partially encircles the neck in one or more substantially uniform helical patterns and wherein a plurality of helical lines helically encircle the neck of the container and define a respective helical pattern such that corresponding ones of the band-engaging thread segments are positioned along a respective one of the helical lines.

13. The container of claim 12, wherein beginning positions of the spaced apart band-engaging thread segments are at a substantially common elevation relative to an opening of the container.

14. The container of claim 12, wherein ending positions of the spaced apart band-engaging thread segments are at a substantially common elevation relative to an opening of the container.

15. The container of claim 3, wherein:

the frangible tamper-evident band portion comprises a band and a plurality of flexible tabs coupled thereto; and the at least one band-engaging thread segment is profiled such that at least a portion of the plurality of flexible tabs of the frangible tamper-evident band portion are folded back while the closure is rotated on the neck.

16. A closure and container system, comprising:

a container including:

a receptacle, a neck extending from the receptacle, a closure-engaging thread segment that at least partially helically encircles the neck, and two or more circumferentially spaced apart band-engaging thread segments, helically opposite that of the closure-engaging thread segment having a same elevation relative to an opening of the container; and a closure including:

a cap portion, a closure thread segment provided on said cap portion to engage the closure-engaging thread segment, and a frangible tamper-evident band portion coupled to the cap portion, and having a band and at least one tab directed inwardly and upwardly with respect to the band and coupled therewith, for engaging the two or more band-engaging thread segments of the neck of the container, wherein the two or more band-engaging thread segments separate the frangible tamper- evident band portion from the cap portion when the closure is rotated off of the neck.

17. The system of claim 16, wherein an orientation of the closure-engaging thread segment is right-handed.

18. The system of claim 17, wherein an orientation of the two or more band-engaging thread segment is left handed.

19. A container for use with a closure having a closure thread segment and a frangible tamper-evident band portion, said container comprising:

a receptacle;

a neck extending from the receptacle;

a closure-engaging thread segment that at least partially helically encircles the neck for engaging the closure thread segment of the closure; and at least two band-engaging thread segments that partially helically encircle the neck in repeating patterns at a common elevation relative to an opening of the container in an orientation opposite the closure-engaging thread segment, for engaging the frangible tamper-evident band portion, and for separating the frangible tamper-evident band portion from the closure when the closure is rotated off of the neck, wherein the at least one band-engaging thread segment is n band-engaging thread segments such that n-1 gaps are formed between circumferentially adjacent band-engaging thread segments, where n is an integer number two or greater.

20. The container of claim 19, wherein the n-1 gaps formed between the adjacent thread segments have a common gap length.

21. A container for use with a closure having a closure thread segment and a frangible tamper-evident band portion, said container comprising:

a receptacle;

a neck extending from the receptacle;

a closure-engaging thread segment that at least partially helically encircles the neck for engaging the closure thread segment of the closure; and two or more band-engaging thread segments that are spaced apart, have beginning positions of respective ones of the spaced apart band-engaging thread segments at a same elevation relative to an opening of the container, and at least partially helically encircle the neck in an orientation opposite the closure-engaging thread segment, for engaging the frangible tamper-evident band portion, and for separating the frangible tamper-evident band portion from the closure when the closure is rotated off of the neck, wherein a plurality of helical lines helically encircle the neck of the container and define a respective helical pattern such that corresponding ones of the band-engaging thread segments are positioned along a respective one of the helical lines.

22. A container for use with a closure having a closure thread segment and a frangible tamper-evident band portion, said container comprising:

a receptacle;

a neck extending from the receptacle;

a closure-engaging thread segment that at least partially helically encircles the neck for engaging the closure thread segment of the closure; and two or more band-engaging thread segments that are spaced apart, have ending positions of respective ones of the spaced apart band-engaging thread segments at a same elevation relative to an opening of the container, and at least partially helically encircle the neck in an orientation opposite the closure-engaging thread segment, for engaging the frangible tamper-evident band portion, and for separating the frangible tamper-evident band portion from the closure when the closure is rotated off of the neck, wherein a plurality of helical lines helically encircle the neck of the container and define a respective helical pattern such that corresponding ones of the band-engaging thread segments are positioned along a respective one of the helical line.

* * * * *

UNITED STATES PATENT AND TRADEMARK OFFICE

CERTIFICATE OF CORRECTION

PATENT NO. : 7,451,885 B2
APPLICATION NO. : 11/047271
DATED : November 18, 2008
INVENTOR(S) : Henry H. Nyman et al.

It is certified that error appears in the above-identified patent and that said Letters Patent is hereby corrected as shown below:

At Column 12, claim 15, line 48 "the at least one band-engaging thread segment is profiled" should read --the two or more band-engaging thread segments are profiled--.

Signed and Sealed this

Third Day of March, 2009

JOHN DOLL
*Acting Director of the United States Patent and Trademark Office*